US010161328B2

(12) United States Patent
Serrano

(10) Patent No.: US 10,161,328 B2
(45) **Date of Patent: *Dec. 25, 2018**

(54) MANAGING SKIP FIRE PHASE TRANSITIONS

(71) Applicant: Tula Technology, Inc., San Jose, CA (US)

(72) Inventor: Louis J. Serrano, Los Gatos, CA (US)

(73) Assignee: Tula Technology, Inc., San Jose, CA (US)

( * ) Notice: Subject to any disclaimer, the term of this patent is extended or adjusted under 35 U.S.C. 154(b) by 92 days.

This patent is subject to a terminal disclaimer.

(21) Appl. No.: 15/299,259

(22) Filed: Oct. 20, 2016

(65) Prior Publication Data

US 2018/0112609 A1 Apr. 26, 2018

(51) Int. Cl.

| | |
|---|---|
| ***F02D 41/00*** | (2006.01) |
| ***F02D 17/02*** | (2006.01) |
| ***F02D 17/00*** | (2006.01) |
| ***F02D 41/30*** | (2006.01) |

(52) U.S. Cl.

CPC ..... *F02D 41/0087* (2013.01); *F02D 17/00* (2013.01); *F02D 17/02* (2013.01); *F02D 41/0085* (2013.01); *F02D 41/3058* (2013.01); *F02D 2200/1002* (2013.01); *F02D 2250/18* (2013.01); *F02D 2250/21* (2013.01)

(58) Field of Classification Search

CPC ... F02D 17/00; F02D 41/0087; F02D 2250/21

See application file for complete search history.

(56) References Cited

U.S. PATENT DOCUMENTS

| | | | | |
|---|---|---|---|---|
| 4,434,767 | A | 3/1984 | Kohama et al. | |
| 4,489,695 | A | 12/1984 | Kohama et al. | |
| 4,509,488 | A | 4/1985 | Forster et al. | |
| 5,377,631 | A | 1/1995 | Schecter | |
| 5,975,052 | A | 11/1999 | Moyer | |
| 6,158,411 | A | 12/2000 | Morikawa | |
| 6,619,258 | B2 | 9/2003 | McKay et al. | |
| 7,063,062 | B2 | 6/2006 | Lewis et al. | |
| 7,066,136 | B2 | 6/2006 | Ogiso | |
| 7,086,386 | B2 | 8/2006 | Doering | |
| 7,503,312 | B2 | 3/2009 | Surnilla et al. | |
| 7,577,511 | B1 | 8/2009 | Tripathi et al. | |
| 7,930,087 | B2 | 4/2011 | Gibson et al. | |
| 8,099,224 | B2 | 1/2012 | Tripathi et al. | |
| 8,839,766 | B2 | 9/2014 | Serrano et al. | |
| 9,086,020 | B2 * | 7/2015 | Pirjaberi | F02D 41/0087 |
| 9,200,575 | B2 * | 12/2015 | Shost | F02D 17/02 |
| 9,200,587 | B2 * | 12/2015 | Serrano | F02D 45/00 |
| 9,249,749 | B2 * | 2/2016 | Brennan | F02D 41/021 |
| 9,328,672 | B2 * | 5/2016 | Serrano | F02D 17/02 |

(Continued)

OTHER PUBLICATIONS

Nagashima et al., U.S. Appl. No. 15/147,690, filed May 5, 2016.

(Continued)

*Primary Examiner* — Sizo Vilakazi
*Assistant Examiner* — Kevin R Steckbauer
(74) *Attorney, Agent, or Firm* — Beyer Law Group LLP

(57) ABSTRACT

Methods and controllers for dynamically altering the phase of a firing sequence during operation of an engine are described. The described methods and controllers are particularly useful in conjunction with dynamic skip fire operation of the engine.

19 Claims, 5 Drawing Sheets

(56) References Cited

U.S. PATENT DOCUMENTS 9,399,964 B2 * 7/2016 Younkins ..... F02D 41/0087
9,476,373 B2 * 10/2016 Younkins ..... F02D 41/0087
9,512,794 B2 * 12/2016 Serrano ..... F02D 41/307
9,528,446 B2 * 12/2016 Pirjaberi ..... F02D 41/0087
9,664,130 B2 * 5/2017 Wilcutts ..... F02D 41/0087
9,689,327 B2 * 6/2017 Younkins ..... F02D 41/266
9,689,328 B2 * 6/2017 Younkins ..... F02D 41/0087
9,745,905 B2 * 8/2017 Pirjaberi ..... F02D 17/02
9,777,658 B2 * 10/2017 Nagashima ..... F02D 41/04
9,964,051 B2 * 5/2018 Pirjaberi ..... F02D 41/0087
10,060,368 B2 * 8/2018 Pirjaberi ..... F02D 41/3058
10,094,313 B2 * 10/2018 Serrano ..... F02D 41/0087
2003/0213467 A1 11/2003 Rayl et al.
2010/0050993 A1 3/2010 Zhao et al.
2013/0092127 A1 * 4/2013 Pirjaberi ..... F02D 41/0087
123/406.23
2013/0092128 A1 * 4/2013 Pirjaberi ..... F02D 41/0087
123/406.23
2013/0289853 A1 * 10/2013 Serrano ..... F02D 45/00
701/110
2014/0102411 A1 * 4/2014 Brennan ..... F02D 41/021
123/350
2014/0190449 A1 7/2014 Phillips
2014/0261316 A1 * 9/2014 Shost ..... F02D 17/02
123/349
2014/0278007 A1 * 9/2014 Wilcutts ..... F02D 41/0087
701/104
2015/0260117 A1 9/2015 Shost et al.
2015/0354470 A1 12/2015 Li et al.
2016/0040614 A1 * 2/2016 Younkins ..... F02D 41/266
123/335
2016/0053697 A1 * 2/2016 Pirjaberi ..... F02D 17/02
123/406.45
2016/0131058 A1 * 5/2016 Younkins ..... F02D 41/0087
123/334
2016/0201586 A1 * 7/2016 Serrano ..... F02D 41/307
701/111
2016/0281618 A1 * 9/2016 Younkins ..... F02D 41/0087
2016/0377007 A9 * 12/2016 Wilcutts ..... F02D 41/0087
701/104
2017/0009729 A1 * 1/2017 Younkins ..... F02D 41/0087
2017/0051689 A1 * 2/2017 Serrano ..... F02D 41/307
2017/0067401 A1 * 3/2017 Pirjaberi ..... F02D 41/0087
2017/0218867 A1 * 8/2017 Younkins ..... F02D 41/0087
2017/0306864 A1 10/2017 Pirjaberi et al.
2017/0342920 A1 * 11/2017 Pirjaberi ..... B60W 20/00
2017/0342921 A1 * 11/2017 Pirjaberi ..... F02D 41/3058
2017/0342922 A1 * 11/2017 Pirjaberi ..... F02D 41/3058
2017/0370309 A1 * 12/2017 Serrano ..... B60W 10/023
2017/0370342 A1 * 12/2017 Nagashima ..... F02D 41/0087
2018/0112644 A1 * 4/2018 Serrano ..... F02D 41/0087
2018/0202379 A1 * 7/2018 Nagashima ..... F02D 41/3058
2018/0230919 A1 * 8/2018 Nagashima ..... F02D 41/3058

OTHER PUBLICATIONS

Pirjaberi et al., U.S. Appl. No. 14/857,371, filed Sep. 17, 2015.
Serrano et al., U.S. Appl. No. 62/353,674, filed Jun. 23, 2016.
Pirjaberi et al., U.S. Appl. No. 15/357,398, filed Nov. 21, 2016.
Serrano et al., U.S. Appl. No. 15/288,847, filed Oct. 20, 2016.
International Search Report and Written Opinion dated Nov. 24, 2017 from International Application No. PCT/US2017/051268.
Serrano, U.S. Appl. No. 15/830,388, filed Dec. 4, 2017.

* cited by examiner

MANAGING SKIP FIRE PHASE TRANSITIONS

BACKGROUND

The present invention relates generally to managing firing sequence phase transitions during skip fire operation of an engine. The invention is also useful in applications where it is desirable to transition from dynamic skip fire engine control into fixed cylinder-based firing patterns.

Skip fire engine control is understood to offer a number of benefits including the potential of increased fuel efficiency. In general, skip fire engine control contemplates selectively skipping the firing of certain cylinders during selected firing opportunities. Thus, for example, a particular cylinder may be fired during one firing opportunity and then may be skipped during the next firing opportunity and then selectively skipped or fired during the next. Skip fire engine operation is distinguished from conventional variable displacement engine control in which a designated set of cylinders are deactivated substantially simultaneously during certain low-load operating conditions and remain deactivated as long as the engine remains in the same displacement mode. Thus, the sequence of specific cylinders firings will always be exactly the same for each engine cycle during operation in any particular variable displacement mode (so long as the engine maintains the same displacement), whereas that is often not the case during skip fire operation. For example, an 8-cylinder variable displacement engine may deactivate half of the cylinders (i.e. 4 cylinders) so that it operates using only the remaining 4 cylinders. Commercially available variable displacement engines available today typically support only two or at most three fixed displacement modes.

In general, skip fire engine operation facilitates finer control of the effective engine displacement than is possible using a conventional variable displacement approach. For example, firing every third cylinder in a 4 cylinder engine would provide an effective displacement of $1/3^{rd}$ of the full engine displacement, which is a fractional displacement that is not obtainable by simply deactivating a set of cylinders. Conceptually, virtually any effective displacement can be obtained using skip fire control, although in practice most implementations restrict operation to a set of available firing fractions, sequences or patterns. The Applicants, has filed a number of patents describing various approaches to skip fire control. By way of example, U.S. Pat. Nos. 8,099,224; 8,464,690; 8,651,091; 8,839,766; 8,869,773; 9,020,735; 9,086,020; 9,120,478; 9,175,613; 9,200,575; 9,200,587; 9,291,106; 9,399,964, and others describe a variety of engine controllers that make it practical to operate a wide variety of internal combustion engines in a dynamic skip fire operational mode. Each of these patents and patent applications is incorporated herein by reference.

Some firing fractions used while operating in a dynamic skip fire mode will result in the same cylinders being fired each engine cycle. When this occurs, it may sometimes be desirable to control which specific cylinders are being fired. The present application describes techniques that can be used to manage the phase of a firing sequence and is particularly useful in conjunction with dynamic skip fire control.

SUMMARY

Methods and controllers for dynamically altering the phase of a firing sequence during operation of an engine are described. The described methods and controllers are particularly useful in conjunction with dynamic skip fire operation of the engine.

In one aspect, a control method includes determining whether a selected working chamber firing decision is consistent with a firing decision that would be made when the firing sequence is in a desired phase. When it is determined that the selected working chamber firing decision is not consistent with the firing decision that would be made when the firing sequence is in the desired phase, the phase of the firing sequence is adjusting. The checking and adjusting steps may then be repeated until the desired phase is attained.

In some implementations, working chamber skip/fire determinations are made using a first order sigma delta converter during operation of the engine. When first order sigma delta conversion is used, the phase adjustment may be accomplished by adding an offset value to an accumulator in the sigma delta converter. In some such implementations, an absolute value of the offset value is a fraction equal to the reciprocal of the denominator of the firing fraction. In other implementations, the absolute value of the offset value is a fraction that is less than the reciprocal of the denominator of the firing fraction.

In some embodiments, the working chambers have a set firing opportunity order and firing sequence phase adjustments are not made during any working cycle that immediately follows a fired working cycle in the preceding working chamber in the working chamber firing opportunity order. Firing sequence phase adjustments may also be constrained such that they are not made during any working cycle that immediately follows a working cycle in which a previous firing sequence phase adjustment was made.

In another aspect a controller utilizes a first order sigma delta converter to direct operation of an engine in a skip fire mode. When the engine transitions to a firing fraction that has a corresponding firing sequence that repeats each engine cycle, the phase of the firing sequence is checked to determine whether it matches a desired firing sequence. If not, the firing sequence phase is altered to a desired second phase to thereby cause a desired set of the working chambers to fire each engine cycle during operation at the second firing fraction.

In some instances, the firing fraction transition may be a transition from an ergodic skip fire firing sequence to a non-ergodic firing fraction.

In some embodiments, the first order sigma delta converter includes an accumulator that tracks the portion of a firing that has been requested but not delivered, or delivered but not requested, and the phase of the firing sequence is altered by adding an offset value to the accumulator.

In some embodiments, when transitioning away of the firing fraction having a desired firing sequence to an ergodic firing fraction, no offset values are added to or subtracted from the accumulator in conjunction with the transition to the ergodic firing fraction.

A variety of skip fire engine controller configured to control an engine in the described manner are also described.

BRIEF DESCRIPTION OF THE DRAWINGS

The invention and the advantages thereof, may best be understood by reference to the following description taken in conjunction with the accompanying drawings in which.

In the drawings, like reference numerals are sometimes used to designate like structural elements. It should also be appreciated that the depictions in the figures are diagrammatic and not to scale.

DETAILED DESCRIPTION

This application describes several techniques that can be used to manage the phase of a firing sequence. Thought of another way, the described techniques allow for the removal of the ambiguity of which cylinders are fired and which cylinders skip when a firing fraction results in a fixed pattern.

Figure 1:
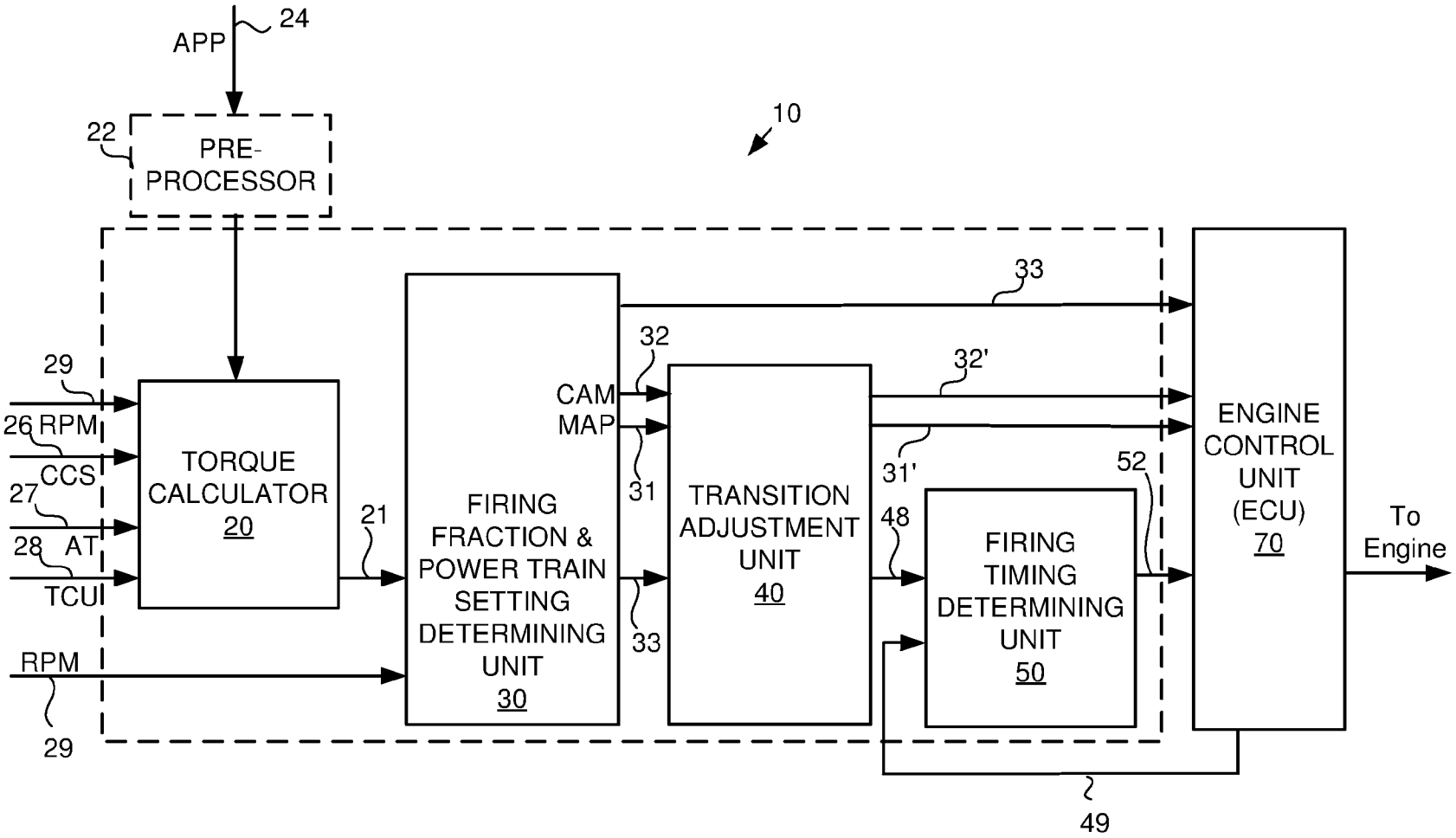
FIG. 1 a block diagram illustrating the architecture of a representative dynamic skip fire engine controller.

The applicant has described a number of sigma delta conversion based skip fire engine control schemes and controllers that make firing decisions dynamically on a firing opportunity by firing opportunity basis without the use of predefined patterns. This technology is sometimes referred to as dynamic skip fire. In some implementations, first order sigma delta conversion is used to determine the firing sequence. A representative first order sigma delta based dynamic skip fire controller architecture is illustrated in FIG. 1 and described below. In general, a requested firing fraction is inputted to the sigma delta converter, which then outputs commands to skip or fire specific cylinder working cycles in a manner that causes the desired percentage of the working cycles to be fired with the remaining working cycles being skipped.

A representative skip fire controller 10 is functionally illustrated in FIG. 1. The illustrated skip fire controller 10 includes a torque calculator 20, a firing fraction and power train settings determining unit 30, a transition adjustment unit 40, and a firing timing determination unit 50. For the purposes of illustration, skip fire controller 10 is shown separately from engine control unit (ECU) 70 which implements the commanded firings and provides the detailed component controls. However, it should be appreciated that in many embodiments the functionality of the skip fire controller 10 may be incorporated into the ECU 70. Indeed incorporation of the skip fire controller into an ECU or power train control unit is expected to be the most common implementation.

The torque calculator 20 is arranged to determine the desired engine torque at any given time based on a number of inputs. The torque calculator outputs a requested torque 21 to the firing fraction and power train settings determining unit 30. The firing fraction and power train settings determining unit 30 is arranged to determine a firing fraction that is suitable for delivering the desired torque based on the current operating conditions and outputs a desired operational firing fraction 33 that is appropriate for delivering the desired torque. Unit 30 also determines selected engine operating settings (e.g., manifold pressure 31, cam timing 32, torque converter slip, etc.) that are appropriate to deliver the desired torque at the designated firing fraction.

In many implementations, the firing fraction and engine and power train settings determining unit 30 selects between a set of predefined firing fractions which are determined to have relatively good NVH characteristics. In such embodiments, there are periodically transitions between desired operational firing fractions. It has been observed that transitions between operational firing fractions can be a source of undesirable NVH. Transition adjustment unit 40 is arranged to adjust the commanded firing fraction and certain engine or power train settings (e.g., camshaft phase, throttle plate position, intake manifold pressure, torque converter slip) during transitions in a manner that helps mitigate some of the transition associated NVH.

The firing timing determining unit 50 is responsible for determining the specific timing of firings to deliver the desired firing fraction. The firing sequence can be determined using any suitable approach. In some preferred implementations, the firing decisions are made dynamically on an individual firing opportunity by firing opportunity basis, which allows desired changes to be implemented very quickly. A variety of firing timing determining units that are well suited for determining appropriate firing sequences based on a potentially time varying requested firing fraction or engine output have been previously described by the Applicant. Many such firing timing determining units are based on a sigma delta converter, which is particularly well suited for making firing decisions on a firing opportunity by firing opportunity basis. In some preferred implementations, the sigma delta converter utilizes first order sigma delta conversion as will be described in more detail below. In other implementations, pattern generators, finite state machines, look up tables with memory, or predefined patterns may be used to facilitate delivery of the desired firing fraction.

The torque calculator 20 receives a number of inputs that may influence or dictate the desired engine torque at any time. In automotive applications, one of the primary inputs to the torque calculator is the accelerator pedal position (APP) signal 24 which indicates the position of the accelerator pedal and is used to indicate the driver's drive torque request. In some implementations the accelerator pedal position signal is received directly from an accelerator pedal position sensor (not shown) while in others an optional preprocessor 22 may modify the accelerator pedal signal prior to delivery to the skip fire controller 10. In embodiments where a cruise controller or an autonomous driving unit (ADU) directs operation of the engine, the drive torque request may be received from a cruise controller (via CCS command 26) or from the ADU. At times, other functional blocks such as a transmission controller (AT command 27), a traction control unit (TCU command 28), etc. may send commands that override or modify the driver requested torque. There are also a number of factors such as engine speed that may influence the torque calculation. When such factors are utilized in the torque calculations, the appropriate inputs, such as engine speed (RPM signal 29) are also provided or are obtainable by the torque calculator as necessary.

Further, in some embodiments, it may be desirable to account for energy/torque losses in the drive train and/or the energy/torque required to drive engine accessories, such as the air conditioner, alternator/generator, power steering pump, water pumps, vacuum pumps and/or any combination of these and other components. In such embodiments, the torque calculator may be arranged to either calculate such values or to receive an indication of the associated loads so that they can be appropriately considered during the desired torque calculation.

The nature of the torque calculation will vary with the operational state of the vehicle. For example, during normal operation, the desired torque may be based primarily on the driver's input, which may be reflected by the accelerator pedal position signal 24. When operating under cruise control, the desired torque may be based primarily on the input from a cruise controller. In autonomous vehicles, the desired torque may be based primarily on the input from an ADU. When a transmission shift is imminent, a transmission shifting torque calculation may be used to determine the desired torque during the shifting operation. When a traction controller or the like indicates a potential loss of traction event, a traction control algorithm may be used to determine the desired torque as appropriate to handle the event. In some circumstances, depression of a brake pedal may invoke specific engine torque control. When other events occur that require measured control of the engine output, appropriate control algorithms or logic may be used to determine the desired torque throughout such events. In any of these situations, the required torque determinations may be made in any manner deemed appropriate for the particular situation. For example, the appropriate torque determinations may be made algorithmically, using lookup tables based on current operating parameters, using appropriate logic, using set values, using stored profiles, using any combinations of the foregoing and/or using any other suitable approach. The torque calculations for specific applications may be made by the torque calculator itself, or may be made by other components (within or outside the ECU) and simply reported to the torque calculator for implementation.

The firing fraction and power train settings determining unit 30 receives requested torque signal 21 from the torque calculator 20 and other inputs such as engine speed 29 and various power train operating parameters and/or environmental conditions that are useful in determining an appropriate operational firing fraction 33 to deliver the requested torque under the current conditions. Power train parameters include, but are not limited to throttle position, cam phase angle, fuel injection timing, spark timing, manifold intake pressure, mass air charge, torque converter slip, transmission gear, etc. The firing fraction is indicative of the fraction or percentage of firings that are to be used to deliver the desired output. In some embodiments the firing fraction may be considered as an analog input into a sigma-delta converter. Often, the firing fraction determining unit will be constrained to a limited set of available firing fractions, patterns or sequences that have been selected based at least in part on their relatively more desirable NVH characteristics (collectively sometimes referred to herein generically as the set of available firing fractions). There are a number of factors that may influence the set of available firing fractions. These typically include the requested torque, cylinder load, engine speed (e.g. RPM), vehicle speed and current transmission gear. They may potentially also include various environmental conditions such as ambient pressure or temperature and/or other selected power train parameters. The firing fraction determining aspect of unit 30 is arranged to select the desired operational firing fraction 33 based on such factors and/or any other factors that the skip fire controller designer may consider important. By way of example, a few suitable firing fraction determining units are described in U.S. Pat. No. 9,086,020 and U.S. patent application Ser. Nos. 13/963,686, 14/638,908, and 15/147,690, each of which are incorporated herein by reference.

The number of available firing fractions/patterns and the operating conditions during which they may be used may be widely varied based on various design goals and NVH considerations. In one particular example, the firing fraction determining unit may be arranged to limit available firing fractions to a set of 29 possible operational firing fractions—each of which is a fraction having a denominator of 9 or less—i.e., 0, 1/9, 1/8, 1/7, 1/6, 1/5, 2/9, 1/4, 2/7, 1/3, 3/8, 2/5, 3/7, 4/9, 1/2, 5/9, 4/7, 3/5, 5/8, 2/3, 5/7, 3/4, 7/9, 4/5, 5/6, 6/7, 7/8, 8/9 and 1. However, at certain (indeed most) operation conditions, the set of available firing fraction may be reduced and sometimes the available set is greatly reduced. In general, the set of available firing fractions tends to be smaller in lower gears and at lower engine speeds. For example, there may be operating ranges (e.g. near idle and/or in first gear) where the set of available firing fractions is limited to just two available fractions—(e.g., 1/2 or 1) or to just 4 possible firing fractions—e.g., 1/3, 1/2, 2/3 and 1. Of course, in other embodiments, the permissible firing fractions/patterns for different operating conditions may be widely varied.

When the available set of firing fractions is limited, various power train operating parameters such as mass air charge (MAC) and/or spark timing will typically need to be varied to ensure that the actual engine output matches the desired output. In the embodiment illustrated in FIG. 1, this functionality is incorporated into the power train settings component of unit 30. In other embodiments, it can be implemented in the form of a power train parameter adjusting module (not shown) that cooperates with a firing fraction calculator. Either way, the power train settings component of unit 30 or the power train parameter adjusting module determines selected power train parameters that are appropriate to ensure that the actual engine output substantially equals the requested engine output at the commanded firing fraction and that the wheels receive the desired brake torque. Torque converter slip may be included in the determination of appropriate power train parameters, since increasing the torque converter slip will generally decrease the perceived NVH. Depending on the nature of the engine, the air charge can be controlled in a number of ways. Most commonly, the air charge is controlled by controlling the intake manifold pressure and/or the cam phase (when the engine has a cam phaser or other mechanism for controlling valve timing). However, when available, other mechanism such as adjustable valve lifters, air pressure boosting devices like turbochargers or superchargers, air dilution mechanism such as exhaust gas recirculation or other mechanisms can also be used to help adjust the air charge. In the illustrated embodiment, the desired air charge is indicated in terms of a desired intake manifold pressure (MAP) 31 and a desired cam phase setting 32. Of course, when other components are used to help regulate air charge, there may be indicated values for those components as well.

The firing timing determining unit 50 is arranged to issue a sequence of firing commands 52 that cause the engine to deliver the percentage of firings dictated by a commanded firing fraction 48. The firing timing determining module 50 may take a wide variety of different forms. By way of example, sigma delta convertors work well as the firing timing determining unit 50. A number of the Applicant's patents and patent applications describe various suitable firing timing determining modules, including a wide variety of different sigma delta based converters that work well as the firing timing determining module. See, e.g., U.S. Pat. Nos. 7,886,715, 8,099,224, 8,131,445, 8,839,766, 9,020,735 and 9,200,587. The sequence of firing commands (sometimes referred to as a drive pulse signal 52) outputted by the firing timing determining unit 50 may be passed to an engine control unit (ECU) 70 or another module such as a combustion controller (not shown in FIG. 1) which orchestrates the actual firings. A significant advantage of using a sigma delta converter or an analogous structure is that it inherently includes an accumulator or memory function that tracks the portion of a firing that has been requested, but not yet delivered. Such an arrangement helps smooth transitions by accounting for the effects of previous fire/no fire decisions.

When a change in firing fraction is commanded by unit 30, it will often (indeed typically) be desirable to simultaneously command a change in the cylinder mass air charge (MAC). Changes in the air charge tend to be realized more slowly than changes in firing fraction can be implemented due to the latencies inherent in filling or emptying the intake manifold and/or adjusting the cam phase. Transition adjustment unit 40 is arranged to adjust the commanded firing fraction as well as various operational parameters such as commanded cam phase and commanded manifold pressure during transitions in a manner that mitigates unintended torque surges or dips during the transition. That is, the transition adjustment unit 40 manages at least the cam phase or one or more other actuators that impact the air charge (e.g. throttle position), and the firing fractions during transitions between commanded firing fractions. It may also control other power train parameters, such as torque converter slip.

In various alternative implementations, the functional blocks that constitute the skip fire controller 10 may be implemented in a wide variety of different forms. For example, any of the specific components may be accomplished algorithmically using a microprocessor, ECU or other computation device, using analog or digital components, using programmable logic, using combinations of the foregoing and/or in any other suitable manner.

As suggested above, one preferred implementation of the firing timing determining unit 50 utilizes first order sigma delta conversion. Table 1 below will be used to facilitate an explanation of the nature of first order sigma delta computation. In general, each time a firing opportunity arises, the sigma delta converter adds the currently requested firing fraction to an accumulated carryover value. If the sum is less than 1, the cylinder is not fired and the sum is carried over to be used in the determination of the next firing. If the sum exceeds 1, the cylinder is fired and the value of 1 is subtracted from the accumulated value. The process is then repeated for each firing opportunity. With this arrangement, the accumulator effectively tracts the portion of a firing that has been requested, but not yet delivered. The table below, which is believed to be self explanatory, illustrates a firing sequence generated in response to a particular sequence of requested firing fractions.

| Cylinder No. | Requested Firing Fraction | Accumulated Value Carryover | Sum | Fire? |
|---|---|---|---|---|
| 1 | .35 | 0 | .35 | No |
| 2 | .36 | .35 | .71 | No |
| 3 | .36 | .71 | 1.07 | Yes |
| 4 | .36 | .07 | .43 | No |
| 5 | .39 | .43 | .82 | No |
| 6 | .41 | .82 | 1.23 | Yes |
| 1 | .45 | .23 | .68 | No |
| 2 | .45 | .68 | 1.13 | Yes |
| 3 | .45 | .13 | .58 | No |
| 4 | .45 | .58 | 1.03 | Yes |
| 5 | .45 | .03 | .48 | No |
| 6 | .45 | .48 | .93 | No |

Of course a generally equivalent controller could be based on negative numbers with the accumulator formulated as a decrement, rather than increment, function. That is, the first tracked firing opportunity could be a fire and the accumulator could be arranged to track the portion of a firing that has been delivered but not yet requested.

Figure 4:
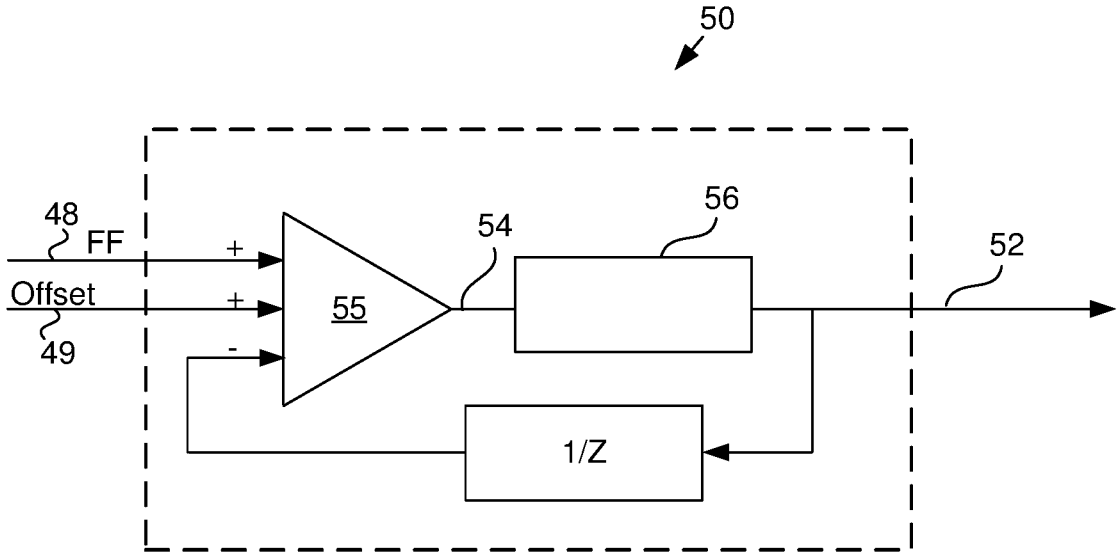
FIG. 4 is a block diagram illustrating a representative firing timing determination unit in accordance with an embodiment that implements a first order sigma delta converter.

The sigma delta converter used in firing timing determining unit 50 can be implemented using digital or analog hardware, using programmable logic, on a processor using programmable code or in any other suitable manner. A representative hardware implementation of a first order sigma delta converter is illustrated in FIG. 4. The converter includes an accumulator/integrator 55 that receives the commanded firing fraction 48 and outputs an analog signal 54 to a comparator/quantizer 56. The quantizer 56 outputs a "1" if input analog signal 54 is equal to or greater than 1 and a "0" if input analog signal is less than 1. The output of the quantizer 56 are the firing commands 52, which are also fed back to the accumulator 55. The cycles of the sigma delta converter are synchronized with the engine firing opportunities so that each bit output by the sigma delta converter may be treated as a skip/fire command for a corresponding engine firing opportunity (cylinder working cycle). Thus, the sigma delta converter outputs a steam of bits (zeros and ones) with each bit being interpreted as either a skip (zero) or fire (one) command for an associated firing opportunity.

In the illustrated embodiment, there are three inputs to the accumulator/integrator 55 which are summed with the value held in the accumulator 55 after each sigma delta cycle. Those inputs include the firing fraction 48, an optional offset 49 (discussed below with respect to FIG. 2) and negative feedback of the accumulator output from the previous sigma delta cycle. In the figure, the symbol 1/z in the feedback path indicates the one sigma delta cycle delay. In any sigma delta cycle in which the summed value (previous accumulated value+firing fraction 48+offset minus previous cycle output) is greater than or equal to 1, the accumulator/integrator outputs a "1" corresponding to a firing command. In any sigma delta cycle in which the summed value is less than 1, the accumulator/integrator 55 outputs a "0" corresponding to a skip command.

First order sigma delta conversion has several advantageous characteristics. One particularly desirable characteristic is that the commanded firings will always be the most evenly spaced sequence possible given any particular requested firing fraction. This spreading of the firings is especially valuable during transitions between different requested firing fractions since the spreading of firings inherently imparted by the accumulator functionality of the sigma delta conversion helps smooth transitions.

The sigma delta converter is capable of issuing firing commands corresponding to any requested firing fraction. However, in many implementations, it has been found that the noise, vibration and harshness (NVH) characteristic of the engine (and hence the drivability of the driven vehicle) can be improved by limiting firing fractions that can be used during normal operation. By way of, example, some skip fire controllers designed by Applicant for use with 8-cylinder engines facilitate operation at any firing fraction between zero (0) and one (1) having an integer denominator of nine (9) or less. Such a controller has a set of 29 potential firing fractions, specifically: 0, 1/9, 1/8, 1/7, 1/6, 1/5, 2/9, 1/4, 2/7, 1/3, 3/8, 2/5, 3/7, 4/9, 1/2, 5/9, 4/7, 3/5, 5/8, 2/3, 5/7, 3/4, 7/9, 4/5, 5/6, 6/7, 7/8, 8/9 and 1. Although 29 potential firing fractions may be possible, not all firing fractions are suitable for use in all circumstances. Rather, at any given time, there may be a much more limited set of firing fractions that are capable of delivering the desired engine torque while satisfying manufacturer imposed drivability and noise, vibration and harshness (NVH) constraints. Skip fire controllers designed for smaller engines (e.g., four cylinder engines) often will utilize a significantly smaller set of potential firing fractions.

Regardless of the number of firing fractions that are potentially available, some requested firing fractions will cause the first order sigma delta converter to generate ergodic firing patterns in which the firings are (over time) evenly distributed between the cylinders (working chambers). Other firing fractions cause the generation of firing patterns in which the same cylinders are fired each engine cycle (e.g., each two rotations of the crankshaft in a 4 stroke piston engine). This occurs any time the denominator of a firing fraction is a factor of the number of engine cylinders. Thus, for example, in an eight cylinder engine, a firing fraction of ¼ would result in the same two cylinders being fired each engine cycle, a firing fraction of ½ would have the same four cylinders being fired each engine cycle, any firing fraction having a denominator of 8 would have the same set of cylinders (equal to the numerator) being fired each engine cycle and so-on. In a four cylinder engine, any firing fraction having a denominator or 2 or 4 will have such a characteristic, and in a six cylinder engine, any firing fraction having a denominator of 2, 3 or 6 will have that characteristic. Still other firing fractions fire only a limited number of cylinders in a pattern that takes multiple engine cycles to complete. For example, a firing fraction of ⅙ intermittently fires only four cylinders in an eight cylinder engine and a firing fraction of ⅚ intermittently skips only 4 of 8 cylinders. Such firing fractions are characterized by the denominator of the firing fraction and the number of engine cylinders containing a common factor, but also having an uncommon factor. In the example above 2 is the common factor and 3 is the uncommon factor.

By its very nature, the described dynamic skip fire does not seek to control which particular cylinders are fired when a firing sequence repeats each engine cycle. Thus, if an engine has a cylinder firing order (or firing opportunity order in the context of skip fire control) of cylinders 1-2-3-4-5-6-7-8, a requested firing fraction of ¼ could result in cylinders 1 and 5 repetitively being fired, or cylinders 2 and 6 repetitively being fired, or cylinders 3 and 7, or cylinders 4 and 8. These different patterns are substantially the same in their output, but they can be said to vary in the phase of the firing sequence.

There are a variety of circumstances in which it may be deemed desirable to control the specific cylinders that are fired when a skip fire controlled engine transitions to, or is operating at, a firing fraction having a firing sequence that repeats each engine cycle. For example, it may be desirable to control the phase of the firings to facilitate diagnostics (e.g., cylinder diagnostics, exhaust gas sensor diagnostics, catalyst diagnostics, etc.). Alternatively, some firing phases may have better NVH characteristics than others and therefore be preferred for NVH related reasons. For example, different sets of four cylinders may sound differently in a V8 engine. In yet another example, it may be desirable to control the specific cylinders that are fired to ensure that all of the cylinders are statistically fired similar amounts over time or to help manage thermal issues during prolonged operation at a given firing fraction. In still other circumstances one cylinder may not be operating as well as others (based on any relevant metric) and it therefore may be desirable to mitigate the use of that cylinder when possible. Of course, there are a wide variety of other reasons why it may be desirable to control the phase of firings that repeat every engine cycle in conjunction with skip fire control.

The simplest way to implement a desired fixed pattern is to stop using the output of the sigma delta converter to determine which cylinder working cycles to fire and to instead start using the desired firing pattern. Although such an approach is quick, it is susceptible to NVH concerns and/or torque sags both on the entrance to and exit from the fixed pattern. This is because the transition may result in multiple fires in a row or too many skips in a row after a firing. To illustrate the problem, consider an immediate transition from a dynamic skip fire firing faction of ⅓ to a fixed pattern that corresponds to a firing fraction of ¼. In some (but not all) circumstances, such a switch can result in a firing sequence that looks like the following:

xooxooX<u>X</u>oooxooo

In this example, "X" represents a fire and "O" represents a skip and the italicized portion represents operation at the old ⅓ firing fraction and the underlined portion represents operation the "new" ¼ firing fraction. It can be seen that there are two immediately following firings (in caps) which, in the context of these relatively lower firing fractions, is generally undesirable from an NVH standpoint and can lead to an unwanted torque surge.

Similarly, a transition back from the fixed pattern to the output of the sigma delta converter can lead to sequences with extended skips such as the following:

x<u>oooxOOO</u>Oxoox

Such extended skip sequences can lead to unwanted torque sags and again can be undesirable from an NVH standpoint.

Figure 2:
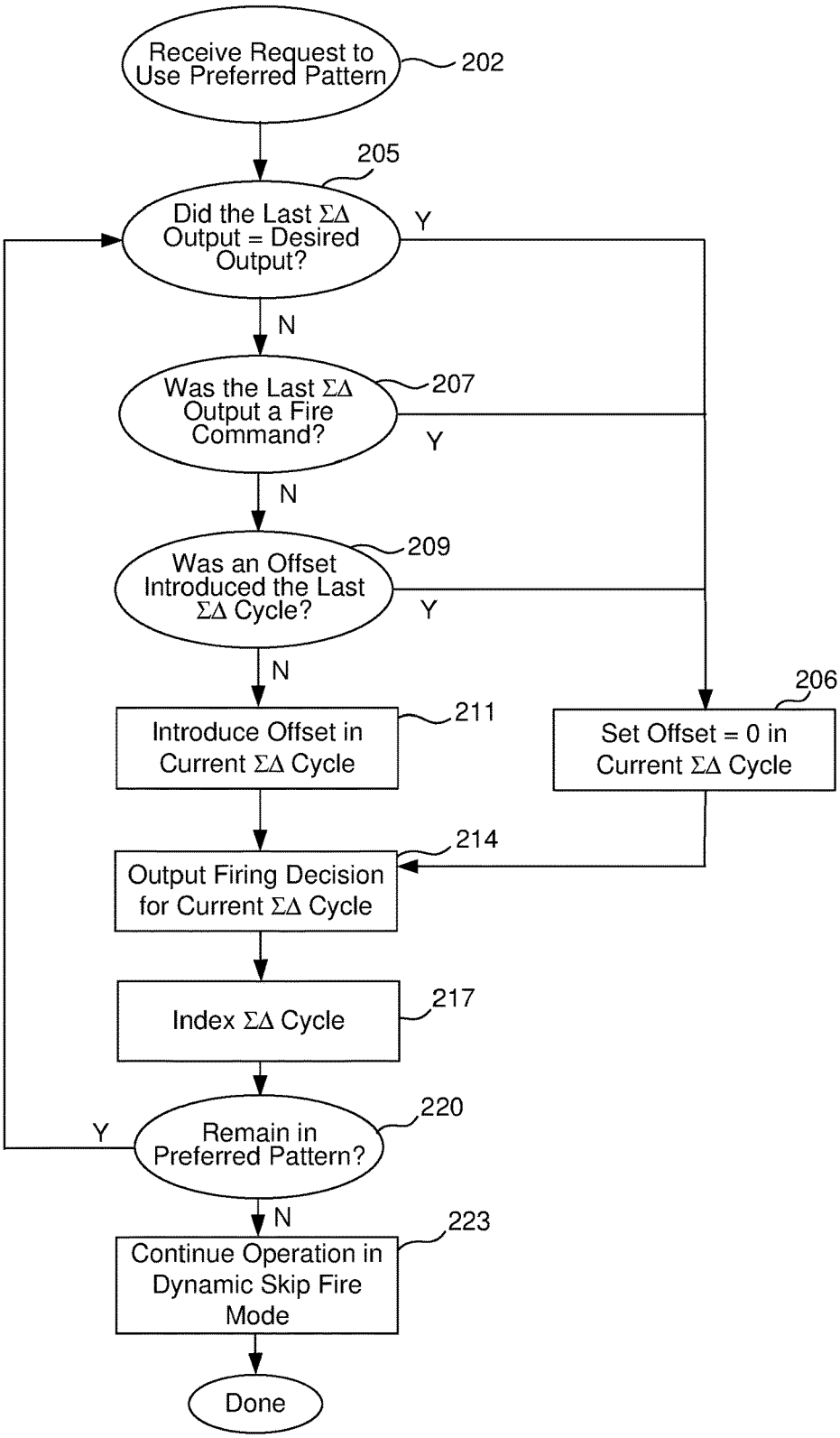
FIG. 2 is a flow chart illustrating a process for transitioning to a preferred sequence phase in accordance with one embodiment.

One way to mitigate the impact of such transitions is to have the sigma delta converter continue to dictate the firings, but to cause the sigma delta converter to alter the phase of its output. This can be done by altering the input to the accumulator in a manner that affects its output. Referring next to FIG. 2, one suitable approach for altering the phase of a firing sequence will be described. In general, the illustrated approach contemplates adding incremental amount to the accumulator at designated intervals to cause the firing timing determining unit 50 to shift the phase of the resulting firing sequence towards and eventually to the desired phase. The incremental amounts added to the accumulator are sometimes referred to herein as "offsets" and are designed to gradually shift the phase of the firing sequence in a smooth manner.

FIG. 4, shows a representative first order sigma delta converter based firing timing determining unit 50 having offset capability. The offset is represented by offset input 49 to accumulator/integrator 55. The other inputs to the accumulator are the firing fraction 48 and the delayed output of the accumulator 52. Output 52 represents the firing commands, for example, a "1" for a fire and "0" for a skip of the first order sigma delta converter.

The method of FIG. 2 begins at 202 with the reception of a request to use a preferred pattern. It is assumed that the requested pattern is consistent with the currently requested operational firing fraction such that the requested pattern corresponds to particular phase of the current firing sequence. Thus, for example, if the currently requested operational firing fraction is ¼, then the requested pattern must also have a corresponding firing density of ¼ and be a pattern that can be output by the first order sigma delta converter based firing timing determining unit 50. If either of these conditions are not met, the request would be ignored. As suggested above, the preferred pattern request can come from any suitable authorized source, including the ECU 70, a diagnostics module (not shown), or other suitable source etc. Such commands can be received directly from the requesting source, through a Controller Area Network (CAN) or other vehicle bus, or through any other appropriate connection.

The sigma delta converter itself typically does not have knowledge of the correlation between its firing commands and the specific cylinder working cycles that are fired based on those commands Therefore, when a specific pattern request is received, it is possible that the phase of the firing sequence already corresponds to the requested pattern. Accordingly, in step 205, the logic initially determines whether the last skip/fire firing decision (i.e., the last output of the sigma delta converter) corresponds to the decision that would be desired for the preferred pattern. If there is a match, it is possible (although often not guaranteed) that the desired firing sequence phase is already in use thereby generating the preferred pattern. Therefore, when a match is found, no offset is added to the sigma delta converter (step 206) and the sigma delta proceeds to output its next firing decision (step 214) in the normal course as represented by the Y branch from decision block 205. Alternatively, if the last firing decision does not match the preferred pattern, then it is known that the phase of the firing sequence is off. Although it is known that the phase is off, it would not necessarily be known how far off the phase actually is. In such circumstances, two checks may be made that look at what occurred during the last sigma delta cycle. If either (a) the last firing decision was a firing command (check 207); or (b) an offset was introduced in the last sigma delta cycle (check 209) then the logic flows to step 206 and no offset is introduced in the current sigma delta cycle. Alternatively, if the last firing command was a skip command (check 207) and no offset was added in the last sigma delta cycle (check 209), then an offset is added to the accumulator in the current sigma delta cycle as represented by step 211. In other embodiments, either or both check 207 and check 209 may be eliminated.

The reasoning behind checks 207 and 209 is to help smooth the transition. When the last firing decision resulted in a fire command, then adding an offset to the accumulator in the current sigma delta cycle increases the probability that two cylinders will be fired in a row when that result would not otherwise have been desirable. Specifically, if the accumulator value is relatively high and the offset is enough to change the output of the sigma delta to a fire command when it otherwise would have been a skip, then two firings would occur in a row in circumstances that shouldn't have had two sequential firings, which may generated unwanted NVH or require fuel inefficient approaches such as excessive spark retard being used to mitigate such unwanted NVH.

Step 209 is an optional step that prevents offsets from being added in two sequential skip/fire determinations. Waiting an additional cycle before making an additional phase change helps to avoid overshooting the desired phase. It also slows larger phase transitions down a bit which tends to help reduce undesirable NVH as well. Specifically, when no offset is added for a particular sigma delta cycle, the phase of the sequence will not be further altered in connection with that sigma delta cycle (and consequently, the associated firing opportunity). If the phase control design considerations encourage slower transitions (which statistically have the advantage of feeling smoother), then two (or more) firing decisions could be required between offset introductions.

After the offset is introduced in step 211, the logic proceeds to 214 where the firing decision associated with the current sigma delta cycle is made. As always, if the total sigma delta sum is 1 or greater, then the firing timing determining unit 50 will output a fire command, whereas if the total sigma delta sum is less than 1, it will output a skip command and carry over the sum for use in the next sigma delta cycle.

When an offset is added to the accumulator (step 211), the magnitude of the offset may vary. In some embodiments, the offset is set equal to the reciprocal of the number of cylinders. For example, if an engine has four cylinders in total, then an offset value of ¼ would be added to the accumulator, which has the net effect of shifting the phase of the firing sequence forward by one cylinder regardless of what the current accumulator value might be (when a sigma delta sum of 1 or greater signifies a firing command for the current working cycle—the sigma delta sum being the sum of the accumulator value, the requested firing fraction and any offset introduced). If an engine has eight cylinders, then an offset value of ⅛ would have the same effect.

In other embodiments, offset values smaller than the reciprocal of the number of engine cylinders can be used. Statistically, this has the effect of making the transitions slower and potentially smoother. For example, if the offset is set to ⅛ in a four cylinder engine, then the transition could take as much as twice as long as would otherwise be the case, which may be desirable is some cases and less desirable in others. In still other embodiments, check 209 could be eliminated and the offset could be lowered.

Sometimes it is not desirable to add an offset that is greater than the reciprocal of the number of cylinders because that introduces the possibility that the desired phase may be skipped over in some circumstances, which is undesirable since it can introduce unnecessary firings to the transition sequence. In some embodiments adding 1/m where the firing fraction is n/m may be used. For example, an offset of ½ may be used when the firing fraction is ½ and an offset of ¼ when the firing fraction is ¼ or ¾. Larger offsets may be undesirable resulting in a torque surge or sag, but integer fractions of 1/m for the offset may be used to slow and smooth the transition.

After the firing offset is introduced in step 211, the logic proceeds to 214 where the firing decision associated with the current sigma delta cycle is made. As always, if the total sigma delta sum is 1 or greater, then the firing timing determining unit 50 will output a fire command, whereas if the total sigma delta sum is less than 1, it will output a skip command and carry over the sum for use in the next sigma delta cycle.

After, the firing decision is output in step 214, the sigma delta converter transitions to its next cycle as represented by 217 and the process is repeated as long as they system remains in a mode that requests the preferred pattern as represented by the yes branch of decision block 220. When the preferred pattern is no longer requested or no longer valid (e.g., due to a new firing fraction being requested), then normal operation of the engine in the dynamic skip fire mode continues. Notably, when the preferred pattern is exited, there is no need to transition back to a previous phase and there is no need to further adjust the accumulator value. This means that there are no NVH impacts whatsoever that are directly related to the exiting of the preferred pattern (although, of course, any transition effects associated with transitioning between different firing fractions should still be accounted as discussed in several of Applicant's other patents and patent applications, as for example, U.S. patent application Ser. Nos. 15/147,690; 14/857,371 and 62/353, 674; and U.S. Pat. Nos. 9,086,020; and 9,200,575; each of which are incorporated herein by reference).

With the approach described above, the phase of the sequence is shifted forward in a smooth manner and the maximum portion of a firing that can effectively be "added" during the entirety of any potential shift will always be less than one full firing. Thus, the extra torque generated during the transition will always be less than the torque imparted by one firing at the current operating conditions. Therefore, in many instances, the shift can be made without trying to compensate for the additional torque generated during the shift. In the event that any particular implementation is concerned about the additional torque that is generated, such concerns can often be mitigated or eliminated using traditional torque mitigation techniques such as altering the fuel and/or air charge during transition, retarding spark, etc.

In the example above, positive offset values were used. However, in other embodiments, negative offsets can be used to accomplish the same result. In such implementations, the transition will cause a slight torque deficit (again always amounting to less than the torque imparted by one firing at the current operating conditions).

It should be appreciated that the approach described above does not require the sigma delta converter itself to be aware of the specific cylinders that are being fired in response to its firing commands and it does not require any of the ECU or other component functionality outside of the sigma delta converter to be aware of the current accumulator value or to try to use such a value in the determination of how to implement a phase shift. Thus, the described approach is very simple to implement and can robustly facilitate a transition to any sequence phase/pattern that corresponds to the current output of the sigma delta converter.

Referring next to the flow chart of FIG. 3, another sequence phase transition approach will be described. As will be seen in the discussion below, the most significant difference between this embodiment and the embodiment described with respect to FIG. 2 is that phantom sigma delta cycles are run to index the sequence rather than adding offsets to the accumulator.

Figure 3:
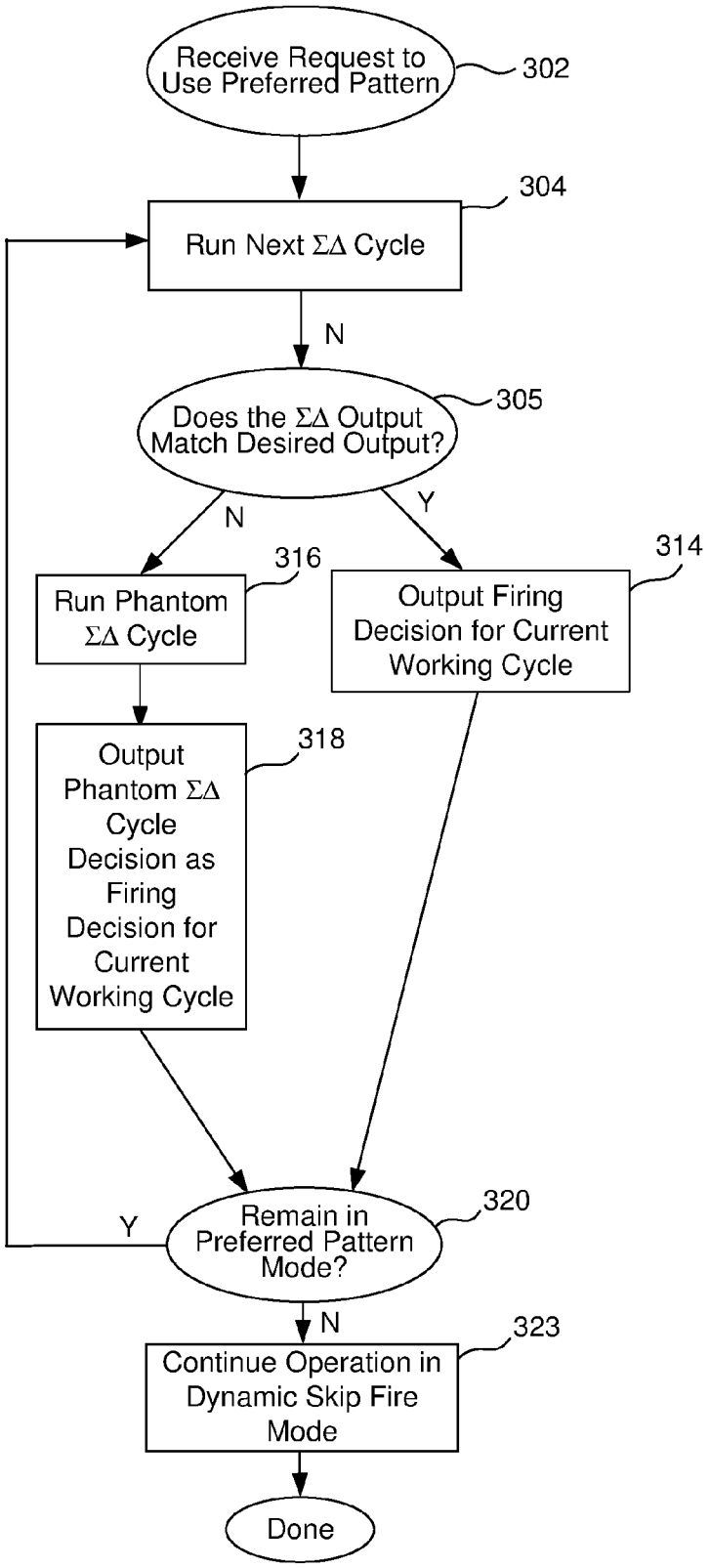
FIG. 3 is a flow chart illustrating a process for transitioning to a preferred sequence phase in accordance with a second embodiment.

In the embodiment of FIG. 3, the method begins at 302 with the reception of a request to use a preferred pattern. Initially, the next sigma delta cycle is run in accordance with standard operation of the sigma delta converter. However, rather than simply outputting the firing decision, a determination is made regarding whether the firing decision corresponds to the decision that would be desired for the preferred pattern in step 305. If there is a match, the firing decision is outputted in a normal manner as represented by step 314. However, if the firing decision does not match the desired output, that firing decision is ignored and another sigma delta cycle is run (step 316) with its output being treated as the proper firing decision for the current working cycle as represented by step 318. When the second sigma delta cycle (sometimes referred to herein as a phantom sigma delta cycle) is executed, another firing fraction value is added to the accumulator. This has the practical effect of indexing the firing sequence forward by an amount equivalent to the current firing fraction. Thereafter, if the firing controller remains in the preferred pattern mode (step 320), the sigma delta converter transitions to its next cycle as represented by 304 and the process is repeated as long as the system remains in a mode that requests the preferred pattern. When the preferred pattern is no longer requested or no longer valid (e.g., due to a new firing fraction being requested), then normal operation of the engine in the dynamic skip fire mode continues as represented by step 323 in the same manner described above with respect to FIG. 2.

It should be apparent that the described approach will cause the firing sequence to index forward by the current firing fraction each time that a regular sigma delta output differs from the desired output. Thus, it could be said that the embodiment of FIG. 3 does not have a delay similar to step 207 of FIG. 2 which allows a phase offset to be added only if the preceding (implemented) firing decision was a skip. Of course, in alternative embodiments, such a shift after skips only delay could readily be added to the embodiment of FIG. 3 as well. Although this approach works well, it should be appreciated that the transition may be less smooth than the approach described with respect to FIG. 2.

A variation of the embodiment of FIG. 3 would be to run one or more additional phantom cycles if the phantom cycle outputs do not match the desired output. The total number of permissible phantom cycles may be varied as desired. For example, is different embodiments, a maximum of two or three phantom cycles may be permitted. In other embodiments, the phantom cycles can be run until a phantom cycle output matches the desired output. The latter approach statistically speeds the transition, but the transition sequence is statistically less smooth.

Figure 5:
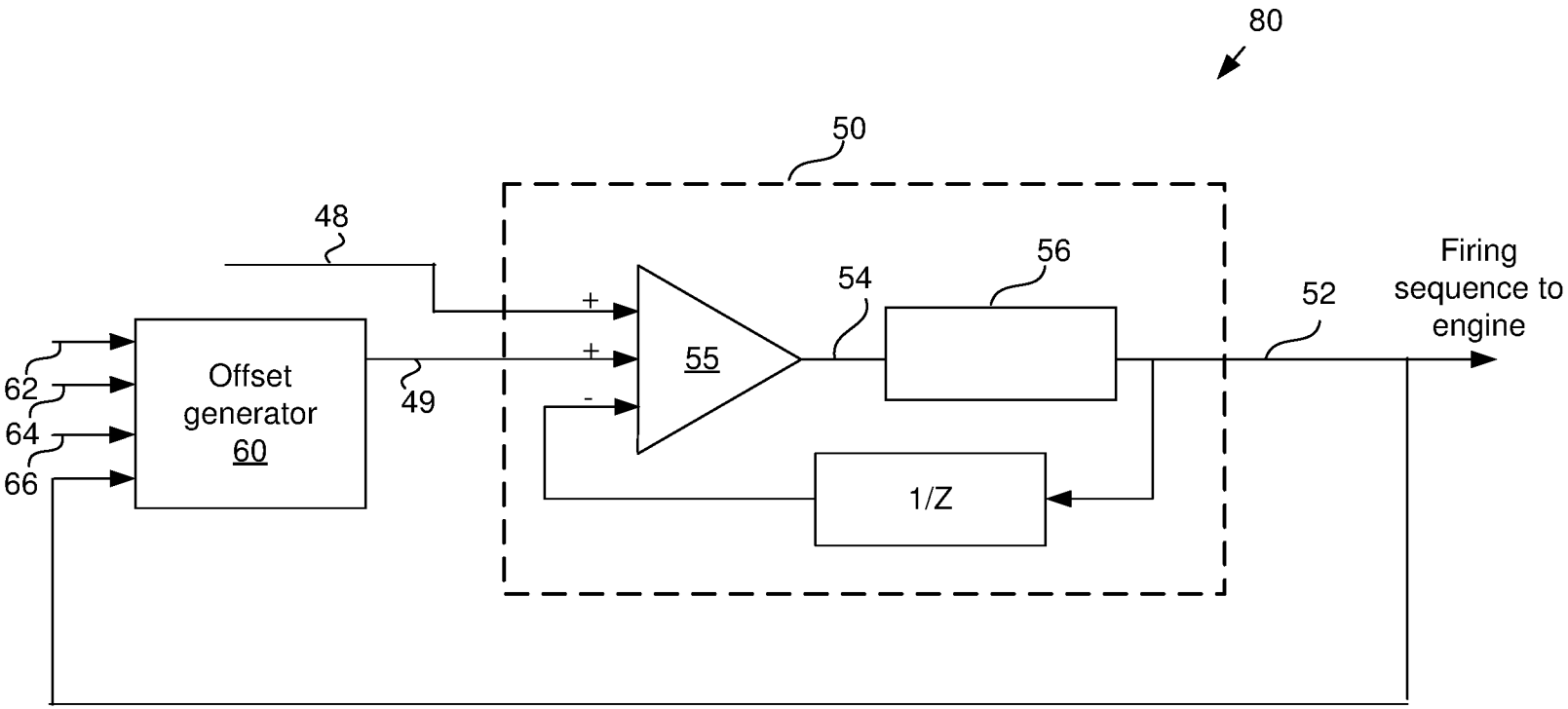
FIG. 5 is a block diagram illustrating a representative system for adding a phase offset to a firing pattern.

In some embodiments an insertion mechanism such as the arrangement shown in FIG. 5 may be used to insert the added phase into the firing pattern. Block diagram 80 includes a first order sigma delta converter as described relative to FIG. 4. An input to the block diagram is the firing fraction signal 48 as described in FIG. 4. The output 52 of the first order sigma delta converter 50 is used to determine the firing sequence and is fed back into the offset generator 60. Other inputs to the offset generator 60 may include firing pattern enable input 62, firing fraction denominator 64, and desired pattern 66. The firing pattern enable input 62 simply controls whether the offset generator 60 is activated. If the offset generator 60 is activated, it compares the first order signal delta output 52 with the desired pattern 66. If the two are equal, i.e. both a "1" or both a "0" then the output offset 49 is set to zero. If the two are unequal, then the offset generator 60 may add a non-zero offset. The decision whether to add an offset may be based at least in part on whether a non-zero offset 49 was added during the previous firing opportunity (similar to step 209 in FIG. 2). The decision whether to add an offset may be based at least in part on whether the last sigma delta output was a fire (similar to step 207 in FIG. 2). If either of these conditions is met, then no offset is added on the current firing opportunity. If both of these conditions are met, then a non-zero offset 49 is added. In some embodiments, one or both of these conditions can be removed. The amount of the offset 49 is determined by the firing fraction denominator input 64 to the offset generator 60. In some embodiments the amount of offset 49 may be equal to a fraction that is the reciprocal of the denominator of the firing fraction. This effectively changes the phase of the resultant skip fire pattern by one firing opportunity. In other embodiments larger or smaller offsets may be used. In particular, an integer fraction of the reciprocal of the denominator of the firing fraction may be used, effectively slowing the phase transition. The insertion mechanism illustrated in block diagram 80 may operate for each firing opportunity determining whether or not to add an offset as directed by the ECU 10 (see FIG. 1).

In the examples set forth above, each of the components and the various checks are refreshed or executed very rapidly, preferably on a firing opportunity by firing opportunity basis. If phantom sigma delta cycles are used, then any such phantom cycles must be executed within the time constraints of a firing opportunity. In commercially available automotive engines, firing opportunities tend to arise at intervals on the order of every several milliseconds to every several hundredths of a second. Although these intervals are quite fast from the standpoint of mechanical systems, modern electronics and microprocessors (including ECUs) are very capable of performing the required steps within the time constraints imposed by the engine firings.

Although only a few embodiments of the invention have been described in detail, it should be appreciated that the invention may be implemented in many other forms without departing from the spirit or scope of the invention. The invention has been described primarily in the context of operating a naturally aspirated, 4-stroke, internal combustion piston engines suitable for use in motor vehicles. However, it should be appreciated that the described applications are very well suited for use in a wide variety of internal combustion engines. These include engines for virtually any type of vehicle—including cars, trucks, boats, aircraft, motorcycles, scooters, etc.; and virtually any other application that involves the firing of working chambers and utilizes an internal combustion engine. The various described approaches work with engines that operate under a wide variety of different thermodynamic cycles—including virtually any type of two stroke or multi-stroke piston engines, diesel engines, Otto cycle engines, Dual cycle engines, Miller cycle engines, Atkinson cycle engines, Wankel engines and other types of rotary engines, mixed cycle engines (such as dual Otto and diesel engines), hybrid engines, radial engines, etc. It is also believed that the described approaches will work well with newly developed internal combustion engines regardless of whether they operate utilizing currently known, or later developed thermodynamic cycles. Boosted engines, such as those using a supercharger or turbocharger may also be used.

It should be also appreciated that any of the methods or operations described herein may be stored in a suitable computer readable medium in the form of executable computer code with the operations being carried out when a processor executes the computer code. Such operations include, but are not limited to, any and all operations performed by the torque calculator, the firing fraction and power train settings determining unit, the transition adjustment unit, the firing timing determination unit, the ECU, or any other module, component or controller described in this application.

Various implementations of the invention are very well suited for use in with conjunction dynamic skip fire operation in which an accumulator or other mechanism tracks the portion of a firing that has been requested, but not delivered, or that has been delivered, but not requested, such that firing decisions may be made on a firing opportunity by firing opportunity basis. However the described techniques are equally well suited for use in virtually any skip fire application (operational modes in which individual cylinders are sometimes fired and sometime skipped during operation in a particular operational mode) including skip fire operation using fixed firing patterns or firing sequences as may occur when using rolling cylinder deactivation and/or various other skip fire techniques. Similar techniques may also be used in variable stroke engine control in which the number of strokes in each working cycle are altered to effectively vary the displacement of an engine.

Furthermore, although the invention has primarily been described in conjunctions with skip fire operation of an engine, it should be appreciated that the same principles can be applied to most any system that improves fuel consumption by varying the displacement of an engine. This can include other variable displacement engines that may wish to transition between two different states that utilize the same number of cylinders or between two different firing pattern phases. It can also include multi-level engine operation where different cylinders are fired at different, dynamically determined output levels, as described, for example, in U.S. Pat. No. 9,399,964, which is incorporated herein by reference. Therefore, the present embodiments should be considered illustrative and not restrictive and the invention is not to be limited to the details given herein, but may be modified within the scope and equivalents of the appended claims.

What is claimed is:

1. A method of altering the phase of a firing sequence during operation of an engine having a plurality of working chambers at a first firing fraction that is less than one, the method comprising:

(a) determining whether a selected working chamber firing decision is consistent with a firing decision that would be made when the firing sequence is in a desired phase; and (b) when it is determined that the selected working chamber firing decision is not consistent with the firing decision that would be made when the firing sequence is in the desired phase, at least sometimes, adjusting the phase of the firing sequence, wherein adjusting the phase takes place while the engine continues to operate at the first firing fraction; and (c) repeating steps (a) and (b) as necessary at least until the desired phase is attained, wherein steps (a) and (b) are performed using a first order sigma delta converter during operation of the engine at the first firing fraction; and whereby the phase of the firing sequence is altered from a first phase to the desired phase, wherein adjusting the phase of the firing sequence while the engine continues to operate at the first firing fraction is accomplished by adding an offset value to an accumulator in the sigma delta converter.

2. A method as recited in claim 1 wherein an absolute value of the offset value is a fraction equal to the reciprocal of the denominator of the first firing fraction.

3. A method as recited in claim 1 wherein an absolute value of the offset value is a fraction less than the reciprocal of the denominator of the first firing fraction.

4. A method as recited in claim 1 wherein an absolute value of the offset value is a reciprocal of a number of working chambers that the engine has.

5. A method as recited in claim 1 wherein the working chambers have a set firing opportunity order and firing sequence phase adjustments are not made during any working cycle that immediately follows a fired working cycle in the preceding working chamber in the working chamber firing opportunity order.

6. A method as recited in claim 1 wherein firing sequence phase adjustments are not made during any working cycle that immediately follows a working cycle in which a firing sequence phase adjustment was made.

7. A method as recited in claim 1 the firing sequence phase adjustment is accomplished by running one or more phantom cycles of the sigma delta converter.

8. A method as recited in claim 1 wherein the offset value is a negative value.

9. A skip fire engine controller configured to perform the method of claim 1.

10. A method of operating an engine having a plurality of working chambers, the method comprising:

operating an engine in a skip fire mode at a first firing fraction, wherein skip/fire determinations are made using a first order sigma delta converter during operation of the engine in the skip fire mode at the first firing fraction;

transitioning to operating the engine at a second firing fraction that has a corresponding second firing sequence that repeats each engine cycle, wherein the second firing fraction is entered at a first phase that corresponds to firing a first set of the working chambers and not firing the remaining working chambers each engine cycle; and altering the phase of the second firing sequence to a desired second phase to thereby cause a second set of the working chambers to fire each engine cycle during operation at the second firing fraction, the second set of working chambers being different than the first set of working chambers, wherein altering the phase of the second firing sequence to the desired second phase while the engine continues to operate at the second firing fraction is accomplished by adding an offset value to an accumulator in the sigma delta converter.

11. A method as recited in claim 10 wherein the first firing fraction has an ergodic skip fire firing sequence.

12. A method as recited in claim 10 wherein the second firing fraction is a simple fraction having a denominator that is a factor of the number of working chambers that the engine has.

13. A method as recited in claim 10 wherein:

the first order sigma delta converter includes an accumulator that tracks the portion of a firing that has been requested but not delivered, or delivered but not requested; and the phase of the second firing sequence is altered by adding an offset value to the accumulator.

14. A method as recited in claim 10 wherein the phase of the second firing sequence is altered by running at least one phantom cycle of the sigma delta converter to thereby cause the generation of a firing decision output that does not influence the firing decision associated with any working chamber working cycle.

15. A method as recited in claim 14 comprising running a plurality of the phantom cycles of the sigma delta converter, wherein the plurality of phantom cycles of the sigma delta conversion immediately follow one another until a desired phase for the second firing sequence is attained.

16. A method as recited in claim 13 wherein an absolute value of the offset value is a fraction that is the reciprocal the denominator of the second firing fraction.

17. A method as recited in claim 13 wherein an absolute value of the offset value is less than the fraction that is the reciprocal the denominator of the second firing fraction.

18. A method as recited in claim 15 further comprising, after operation at the second firing fraction at the altered phase, transitioning to a third firing fraction that is different that the second firing fraction; and wherein no offset values are added to or subtracted from the accumulator in conjunction with the transition to the third firing fraction.

19. A skip fire engine controller configured to perform the method of claim 10.

* * * * *